US009610468B2

(12) United States Patent
Zavitsanos et al.

(10) Patent No.: US 9,610,468 B2
(45) Date of Patent: Apr. 4, 2017

(54) DESTRUCTION OF CHEMICAL AGENTS BY A WICKING COMPOUND AND HIGH TEMPERATURE INCENDIARY

(71) Applicant: General Sciences, Incorporated, Souderton, PA (US)

(72) Inventors: Peter Zavitsanos, Gwynedd Valley, PA (US); Anthony Rozanski, Macungie, PA (US); Charles Files, Perkasie, PA (US); Noah Stotz, Pennsburg, PA (US)

(73) Assignee: GENERAL SCIENCES, INCORPORATED, Souderton, PA (US)

( * ) Notice: Subject to any disclaimer, the term of this patent is extended or adjusted under 35 U.S.C. 154(b) by 433 days.

(21) Appl. No.: 14/178,949

(22) Filed: Feb. 12, 2014

(65) Prior Publication Data

US 2015/0224353 A1 Aug. 13, 2015

(51) Int. Cl.

| | |
|---|---|
| ***C06B 33/00*** | (2006.01) |
| ***C06B 33/12*** | (2006.01) |
| ***D03D 23/00*** | (2006.01) |
| ***D03D 43/00*** | (2006.01) |
| ***A62D 3/38*** | (2007.01) |
| ***F42D 1/04*** | (2006.01) |
| ***C06B 33/06*** | (2006.01) |
| ***C06B 33/02*** | (2006.01) |
| ***C06B 45/00*** | (2006.01) |

(Continued)

(52) U.S. Cl.

CPC ..... *A62D 3/38* (2013.01); *A62D 3/40* (2013.01); *C06B 21/0091* (2013.01); *C06B 33/00* (2013.01); *C06B 33/02* (2013.01); *C06B 33/06* (2013.01); *C06B 33/12* (2013.01); *C06B 45/00* (2013.01); *F42D 1/04* (2013.01); *A62D 2101/02* (2013.01)

(58) Field of Classification Search

USPC .... 149/2, 37, 40, 108.2, 109.2, 109.4, 109.6

See application file for complete search history.

(56) References Cited

U.S. PATENT DOCUMENTS

| | | | | |
|---|---|---|---|---|
| 8,118,955 | B2 | 2/2012 | Zavitsanos et al. | |
| 2005/0199323 | A1* | 9/2005 | Nielson | C06B 27/00 149/19.3 |

(Continued)

FOREIGN PATENT DOCUMENTS

| | | | | |
|---|---|---|---|---|
| AU | WO 8500364 | A1 * | 1/1985 | C06B 27/00 |

*Primary Examiner* — James McDonough

(74) *Attorney, Agent, or Firm* — RatnerPrestia

(57) ABSTRACT

Compositions, devices, and methods for destroying chemical warfare agents, independent of their chemical make-up, include (i) at least one reactive metal; (ii) at least one oxidizer; and (iii) a binder. In one embodiment, the self-sustaining reactive composition includes magnesium powder, iron oxide powder, potassium perchlorate powder, and silicone gel. In another embodiment, the self-sustaining reactive composition includes manganese powder, lithium perchlorate powder, lithium peroxide powder, and silicone gel. The reactive metal(s), oxidizer(s), binder, and their respective amounts, are selected such that, following ignition of the composition, the composition is capable of producing a solid mass of ash (wicking composition) that increases the surface area of the chemical agent material and provides a site for combustion and/or thermal degradation of the chemical agent to occur.

19 Claims, 1 Drawing Sheet

(51) Int. Cl.

| | |
|---|---|
| ***C06B 21/00*** | (2006.01) |
| ***A62D 3/40*** | (2007.01) |
| *A62D 101/02* | (2007.01) |

(56) References Cited

U.S. PATENT DOCUMENTS

2010/0116384 A1* 5/2010 Mendenhall ..... C06B 21/0091 149/2
2013/0048163 A1* 2/2013 Hafner ..... C06B 25/24 149/6

* cited by examiner

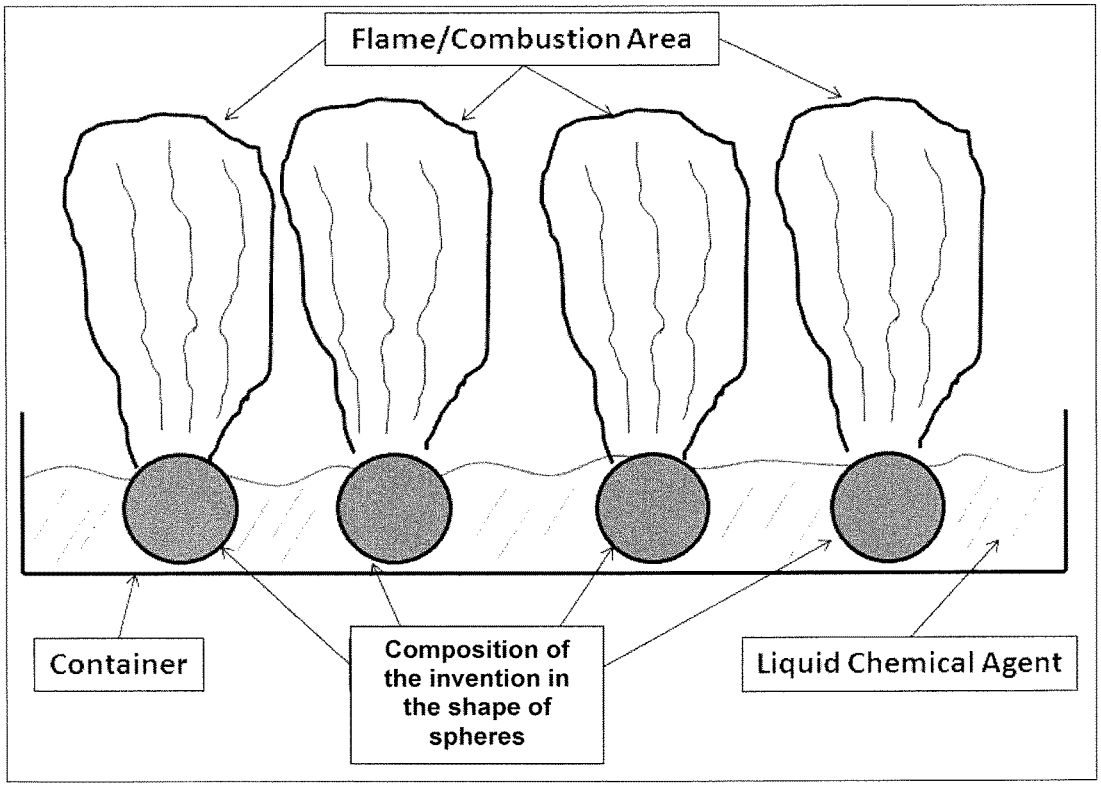
Flame/Combustion Area
Container
Composition of the invention in the shape of spheres
Liquid Chemical Agent

DESTRUCTION OF CHEMICAL AGENTS BY A WICKING COMPOUND AND HIGH TEMPERATURE INCENDIARY

FIELD OF THE INVENTION

The present invention relates to the production of a high temperature, high thermal energy environment capable of causing combustion or thermal degradation of, or otherwise rendering ineffective, dispersed chemical agent materials.

BACKGROUND

Proliferation of hazardous chemical warfare agents has resulted in the need to develop countervailing compositions, methods and devices for destroying, or at least rendering ineffective, such agents. One important consideration in developing such compositions, methods and devices is that the chemical agents must be destroyed in such a way so as to preclude or minimize the dispersing of the chemical agents into the environment to thus avoid collateral damage. Moreover, chemical agents are very difficult to combust as a simple pool of liquid, as they have low vapor pressures and high ignition points. There exists a need for compositions, methods and devices that can defeat chemical warfare agents by producing a high temperature, high thermal energy environment capable of rendering the chemical agent materials ineffective, independent of the chemical makeup of the agent materials.

SUMMARY OF THE INVENTION

An embodiment of the present invention provides a self-sustaining reactive composition for defeating chemical agent material comprising (i) at least one reactive metal; (ii) at least one oxidizer; and (iii) a binder. In one embodiment, the self-sustaining reactive composition includes magnesium powder, iron oxide powder, potassium perchlorate powder, and silicone gel. In another embodiment, the self-sustaining reactive composition includes manganese powder, lithium perchlorate powder, lithium peroxide powder, and silicone gel. Following ignition, the composition is capable of self-reacting to generate an elevated temperature and elevated thermal energy sufficient to render ineffective the chemical agent material by wicking action (i.e., by generating a solid ash structure that absorbs the chemical agent material, thereby increasing the surface area of the chemical agent material) and combustion with atmospheric oxygen.

Another embodiment of the present invention provides a delivery vehicle (e.g., a canister, bomb, rocket, or hand-held device) that contains the self-sustaining reactive composition in the form of one or more molded shapes (e.g., spheres, discs, and/or cubes). The delivery vehicle preferably comprises a propellant (e.g., a thermochemical driver comprising a mixture of titanium and boron).

Another embodiment of the present invention provides a method for defeating chemical agent material that comprises generating a solid wicking compound by igniting a self-sustaining reactive composition comprising (i) at least one reactive metal; (ii) at least one oxidizer; and (iii) a binder. Following ignition, the composition self-reacts to generate an elevated temperature and elevated thermal energy sufficient to render ineffective the chemical agent material by absorbing the chemical agent material into the solid wicking compound, thereby increasing the surface area of the chemical agent material and enhancing the destruction of the chemical agent material by combustion with atmospheric oxygen.

BRIEF DESCRIPTION OF THE FIGURES

The invention may be further understood by reference to the drawing in which:

FIG. 1 depicts the facilitation of chemical agent combustion via wicking action by a self-sustaining reactive composition in accordance with an embodiment of the present invention.

DETAILED DESCRIPTION OF THE INVENTION

The present invention relates to compositions, methods, and devices for producing high temperature, high thermal energy environments capable of causing the combustion and/or thermal degradation (or otherwise rendering ineffective) dispersed chemical agent materials, independent of the chemical makeup of the chemical agent materials, by a wicking composition capable of enhancing chemical agent combustion with atmospheric oxygen. To achieve the destruction of harmful chemical agents, the invention provides self-propagating high temperature reactive materials capable of self-sustaining reactions with the evolution of large quantities of thermal energy, creating an area of high temperatures (in excess of 800° C.), and providing a wicking composition that greatly enhances the combustion and/or thermal degradation of the chemical agent.

Chemical agents are very difficult to combust as a simple pool of liquid, as they have low vapor pressures and high ignition points. Many chemical agents need to be heated to create enough vapor to sustain combustion, or they require large amounts of thermal energy to decompose them. The compositions, methods, and devices of the present invention provide a solution to this problem. By absorbing the liquid chemical agent and spreading it throughout an ash structure (also referred to herein as a wicking composition or wicking compound), much more liquid surface area is available for combustion with atmospheric oxygen, thus mimicking a vapor state created through heat application, similar to the operation of a wick in a wax candle.

The high temperature, high thermal energy environment is generally created by the exothermic reaction of a combination of elements and compounds designed to 1) self-react once ignited, 2) maintain a reaction and produce oxygen until the available original material is consumed, 3) elevate additional included material to a higher energy state, where it will be more reactive with any available atmospheric and/or ambient oxygen to produce a secondary exothermic reaction to release additional thermal energy, 4) produce a wicking compound as a result of the self-reaction to absorb the chemical agent material(s), increase the surface area of the chemical agent material(s), and provide a site for combustion and/or thermal degradation of the chemical agent to occur, and optionally 5) provide additional oxygen directly at the site of combustion.

According to particular embodiments, the present invention provides metal-oxidizer systems, wherein a reactive metal is combined with an oxidizer to form a castable, stable mixture at room temperature and at temperatures expected within normal human experiences (cold/hot). Given an ignition stimulus, the oxidizer begins to decompose, releasing some of its oxidation potential, which can be oxygen or a halogen element (fluorine, chlorine, bromine, iodine). The released oxidizer reacts with the metal, creating a metal oxide and releasing heat. The released heat continues the decomposition of the oxidizer, and the subsequent metal oxidation reaction, until either the metal or the oxidizer is completely or substantially consumed. The resulting product is an expanded porous solid mass of ash acting as a large wick (also referred to herein as a wicking composition or wicking compound) which brings the chemical agent to the surface for ignition and continues combustion with atmospheric oxygen.

According to particular embodiments, a self-sustaining reactive composition for defeating chemical agent material comprises, consists essentially of, or consists of (i) at least one reactive metal, (ii) at least one oxidizer; and (iii) a binder, wherein said composition, when ignited, self-reacts to generate an elevated temperature and elevated thermal energy sufficient to render ineffective the chemical agent material by wicking action and combustion with atmospheric oxygen. The reactive metal(s) may comprise, for example, magnesium, manganese, or a combination thereof. The oxidizer(s) may comprise, for example, iron oxide, potassium perchlorate, lithium perchlorate, lithium peroxide, or a combination thereof. The binder preferably comprises silicone gel (e.g., silicone RTV gel). The reactive metal(s), oxidizer(s), binder, and their respective amounts, are selected such that, following ignition of the composition, the composition is capable of producing a solid mass of ash (wicking composition) that increases the surface area of the chemical agent material and provides a site for combustion and/or thermal degradation of the chemical agent to occur.

The inclusion of the binder provides a component to the reactive mixture that, upon reaction, aids in the creation of the ash product that absorbs liquid chemical agents. The liquid chemical agent becomes dispersed throughout the ash structure, increasing the surface area of the chemical agent many times over compared to a simple pool of liquid. This increased surface area enhances the ability of the metal oxidation reaction to cause combustion and/or thermal degradation (depending on the exact chemical structure of the agent material) of the absorbed chemical agent. The combustion reaction of the chemical agent material generally continues after the metal oxidation reaction stops, and proceeds through the working action of the solid ash structure, which brings hot liquid chemical agent to the surface, thus enhancing the neutralization of the chemical agent by combustion with air and, in some cases, the additional oxygen produced by the metal oxidation reaction (particularly when the composition comprises manganese, lithium perchlorate, lithium peroxide and silicone gel).

The excess heat produced during the course of the reaction causes the combustion and thermal degradation of available chemical agents through convective, conductive and radiative heat transfer into the chemical agent materials, followed by combustion at the wick points, until complete or substantial combustion is achieved. Equipment and supplies that are in the range of the reaction front will become exposed to an environment of high temperatures that can affect the equipment and supplies in different ways. Some materials will be combusted, such as paper-based products and flammable solvents, and some will be degraded or damaged thermally, such as electronic equipment, processing equipment and storage containers.

According to one embodiment of the self-sustaining reactive compositions of the present invention, the at least one reactive metal comprises, consists essentially of, or consists of magnesium powder; the at least one oxidizer comprises, consists essentially of, or consists of iron oxide powder, potassium perchlorate powder, or a combination thereof; and the binder comprises, consists essentially of, or consists of silicone gel. These compositions, based on a magnesium-iron oxide reactive formulation, are capable of a self-sustaining reaction with the evolution of heat and oxygen, as described herein. The heat released during the exothermic reaction is suitable for raising the temperature of the ambient environment to a point capable of performing work, such as combustion or degradation of chemical agents. Compositions comprising (i) magnesium powder, (ii) iron oxide powder and/or potassium perchlorate powder, and (iii) silicone gel are referred to herein as a "first mixture."

According to particular embodiments, the composition comprises, consists essentially of, or consists of between about 30% by mass to about 70% by mass iron oxide powder, between about 10% by mass to about 40% by mass magnesium powder, between about 0.01% by mass to about 3.0% by mass potassium perchlorate powder, and between about 10% by mass to about 40% by mass silicone gel. For example, the composition may comprise, consist essentially of, or consist of between about 45% by mass to about 55% by mass iron oxide powder, between about 20% by mass to about 30% by mass magnesium powder, between about 0.5% by mass to about 1.5% by mass potassium perchlorate powder, and between about 20% by mass to about 30% by mass silicone gel.

According to another embodiment of the self-sustaining reactive compositions of the present invention, the at least one reactive metal comprises, consists essentially of, or consists of manganese powder; the at least one oxidizer comprises, consists essentially of, or consists of lithium perchlorate powder, lithium peroxide powder, or a combination thereof; and the binder comprises, consists essentially of, or consists of silicone gel. These compositions, based on a lithium perchlorate-lithium peroxide-manganese/manganese reactive formulation, are capable of a self-sustaining reaction with the evolution of heat and oxygen, as described herein. The heat released during the exothermic reaction is suitable for raising the temperature of the ambient environment to a point capable of performing work, such as combustion or degradation of chemical agents. The formulation also produces oxygen as a normal by-product of reaction; this oxygen is then available to enhance combustion of the chemical agent material. Compositions comprising (i) manganese powder, (ii) lithium perchlorate powder and/or lithium peroxide powder, and (iii) silicone gel are referred to herein as a "second mixture."

According to particular embodiments, the composition comprises, consists essentially of, or consists of between about 50% by mass to about 90% by mass lithium perchlorate powder, between about 1% by mass to about 7% by mass lithium peroxide powder, between about 0.5% by mass to about 8% by mass manganese powder, and between about 10% by mass to about 40% by mass silicone gel. For example, the composition may comprise, consist essentially of, or consist of between about 65% by mass to about 75% by mass lithium perchlorate powder, between about 2.5% by mass to about 3.5% by mass lithium peroxide powder, between about 3% by mass to about 4% by mass manganese powder, and between about 20% by mass to about 30% by mass silicone gel.

According to particular embodiments, the self-sustaining reactive composition of the present invention may comprise, consist essentially of, or consist of (i) a first mixture comprising magnesium powder, iron oxide powder, potassium perchlorate powder, and silicone gel; or (ii) a second mixture comprising lithium perchlorate powder, lithium peroxide powder, manganese powder, and silicone gel; or (iii) both the first mixture and the second mixture. Any ratio of the first mixture to the second mixture that is effective in generating a wicking composition may be used.

The first mixture and second mixture are each preferably mixed as dry powders, blended through rolling, and then blended with silicone gel, which acts as a binder and is a prime component in the development of the wicking ash that is generated upon ignition and reaction of the compositions. Thus, according to a further embodiment, a method for making a self-sustaining reactive composition in accordance with embodiments of the invention described herein comprises mixing dry powder components of the composition (e.g., the reactive metal(s) and oxidizer(s)) with a binder (preferably silicone gel). The dry powder components may be blended through rolling, and the composition is preferably molded into a shape (e.g., a sphere, disc, or cube).

In accordance with another embodiment of the present invention, the self-sustaining reactive composition is contained inside a delivery vehicle (i.e., a device, such as a canister, bomb, rocket, hand-held device, etc.). The composition is preferably in the form of one or more molded shapes (e.g., selected from the group consisting of spheres, discs, and cubes) within the delivery vehicle. According to preferred embodiments, the delivery vehicle further comprises a propellant, such as a thermochemical driver comprising a mixture of titanium and boron. Such mixtures are described, for example, in U.S. Pat. No. 8,118,955, which is incorporated by reference herein.

In accordance with another embodiment of the present invention, a method for defeating chemical agents comprises generating a solid wicking compound by igniting a self-sustaining reactive composition comprising, consisting essentially of, or consisting of (i) at least one reactive metal; (ii) at least one oxidizer; and (iii) a binder. As discussed above, the composition self-reacts to generate an elevated temperature and elevated thermal energy sufficient to render ineffective the chemical agent material by absorbing the chemical agent material into the solid wicking compound, thereby increasing the surface area of the chemical agent material and enhancing the destruction of the chemical agent material by combustion with atmospheric oxygen. The method may further comprise propelling the composition in the direction of the chemical agent material.

The following example is provided to describe the invention in greater detail and is intended to illustrate, not limit, the invention.

EXAMPLES

Example 1

The present invention was demonstrated as shown schematically in FIG. 1, which shows combustion of a chemical agent simulant. A tray comprising several pounds of full TEP (Triethyl Phosphate) was used as a chemical agent simulant. In a first experiment, spheres of the first mixture described herein (magnesium powder, iron oxide powder, potassium perchlorate powder, and silicone gel) were ignited and propelled from a tubular canister by the thrust of a high temperature incendiary composition comprising a titanium (Ti)/boron (B)/gasifier mixture. In a second experiment, one-hundred grams of the second mixture described herein (manganese powder, lithium perchlorate powder, lithium peroxide powder, and silicone gel) were applied to a tray comprising several pounds of full TEP. In both experiments, the combustion of TEP outlasted the wicking material reaction and continued until all TEP was burned by wicking action by the product ash.

Example 2

Another demonstration was conducted in a facility where a 55 gallon drum of TEP was ruptured by a high explosive (HE) fragment-producing charge, causing the 55 gallon drum to drain in approximately 30 seconds, followed by initiation of the HTI/wicking compound payload, 25 seconds after the HE detonation, with a burn duration of approximately 55 seconds. The HTI payload was designed to produce a minimum amount of gas to keep chamber pressure low, to produce a hot particulate fireball and to produce clumps of a wicking compound to sustain combustion of the TEP pool following completion of the HTI reaction. During this test the TEP concentration (within a venting chimney), oxygen level and temperature of the chamber were monitored. The TEP concentration within the chimney spiked following the HE/fragment rupture of the TEP drum, and then fell to essentially zero during the HTI reaction. It was concluded that practically all the liquid TEP exposed to the payload products was consumed with minimal to zero escape. It was noted that the fraction of the wicking payload compared to the amount of liquid neutralized can be orders of magnitude lower.

Although the present invention has been described in connection with specific embodiments, it should be understood that the invention as claimed should not be unduly limited to such specific embodiments. Indeed, various modifications and variations of the described compositions and methods of the invention will be apparent to those of ordinary skill in the art and are intended to be within the scope of the appended claims.

What is claimed is:

1. A self-sustaining reactive composition for defeating chemical agent material comprising:

(i) at least one reactive metal comprising magnesium powder, wherein the composition comprises between about 10% by mass to about 40% by mass magnesium powder;

(ii) at least one oxidizer comprising a combination of iron oxide powder and potassium perchlorate powder, wherein the composition comprises between about 30% by mass to about 70% by mass iron oxide powder and between about 0.01% by mass to about 3.0% by mass potassium perchlorate powder; and (iii) a binder comprising silicone gel, wherein the composition comprises between about 10% by mass to about 40% by mass silicone gel, wherein said composition, when ignited, is configured to self-react to generate an elevated temperature and elevated thermal energy sufficient to render ineffective said chemical agent material by wicking action and combustion with atmospheric oxygen.

2. The composition of claim 1 comprising between about 45% by mass to about 55% by mass iron oxide powder, between about 20% by mass to about 30% by mass magnesium powder, between about 0.5% by mass to about 1.5% by mass potassium perchlorate powder, and between about 20% by mass to about 30% by mass silicone gel.

3. The composition of claim 1, wherein the at least one reactive metal comprises manganese powder, and the at least one oxidizer comprises lithium perchlorate powder, lithium peroxide powder, or a combination thereof.

4. The composition of claim 3, wherein the binder comprises silicone gel.

5. The composition of claim 4 comprising between about 65% by mass to about 75% by mass lithium perchlorate powder, between about 2.5% by mass to about 3.5% by mass lithium peroxide powder, between about 3% by mass to about 4% by mass manganese powder, and between about 20% by mass to about 30% by mass silicone gel.

6. The composition of claim 1, wherein said composition is in the form of one or more molded shapes selected from the group consisting of spheres, discs, and cubes.

7. A delivery vehicle comprising the composition of claim 1.

8. A delivery vehicle comprising the composition of claim 1 in the form of one or more molded shapes selected from the group consisting of spheres, discs, and cubes.

9. The delivery vehicle of claim 7 further comprising a propellant.

10. The delivery vehicle of claim 9, wherein the propellant is a thermochemical driver comprising a mixture of titanium and boron.

11. The delivery vehicle of claim 7, wherein the delivery vehicle is a canister, a bomb, a rocket, or a hand-held device.

12. A method for defeating chemical agent material comprising:

generating a solid wicking compound by igniting the self-sustaining reactive composition of claim 1, wherein said composition self-reacts to generate an elevated temperature and elevated thermal energy sufficient to render ineffective said chemical agent material by absorbing the chemical agent material into the solid wicking compound, thereby increasing the surface area of the chemical agent material and enhancing the destruction of the chemical agent material by combustion with atmospheric oxygen.

13. The method of claim 12 further comprising propelling the composition by the thrust of a thermochemical driver.

14. The method of claim 12, wherein the composition comprises:

(i) between about 30% by mass to about 70% by mass iron oxide powder, between about 10% by mass to about 40% by mass magnesium powder, between about 0.01% by mass to about 3.0% by mass potassium perchlorate powder, and between about 10% by mass to about 40% by mass silicone gel; or (ii) between about 50% by mass to about 90% by mass lithium perchlorate powder, between about 1% by mass to about 7% by mass lithium peroxide powder, between about 0.5% by mass to about 8% by mass manganese powder, and between about 10% by mass to about 40% by mass silicone gel.

15. A method for making the self-sustaining reactive composition of claim 1 for defeating chemical agent material comprising:

mixing (i) the at least one reactive metal in the form of a dry powder, (ii) the at least one oxidizer in the form of a dry powder, and (iii) the binder, wherein said composition, when ignited, self-reacts to generate an elevated temperature and elevated thermal energy sufficient to render ineffective said chemical agent material by wicking action and combustion with atmospheric oxygen.

16. The method of claim 15, further comprising molding the composition into a shape selected from the group consisting of spheres, discs, and cubes.

17. A self-sustaining reactive composition for defeating chemical agent material comprising:

(i) at least one reactive metal comprising manganese powder, wherein the composition comprises between about 0.5% by mass to about 8% by mass manganese powder;

(ii) at least one oxidizer comprising a combination of lithium perchlorate powder and lithium peroxide powder, wherein the composition comprises between about 50% by mass to about 90% by mass lithium perchlorate powder and between about 1% by mass to about 7% by mass lithium peroxide powder; and (iii) a binder comprising silicone gel, wherein the composition comprises between about 10% by mass to about 40% by mass silicone gel, wherein said composition, when ignited, is configured to self-react to generate an elevated temperature and elevated thermal energy sufficient to render ineffective said chemical agent material by wicking action and combustion with atmospheric oxygen.

18. A method for defeating chemical agent material comprising generating a solid wicking compound by igniting the self-sustaining reactive composition of claim 17, wherein said composition self-reacts to generate an elevated temperature and elevated thermal energy sufficient to render ineffective said chemical agent material by absorbing the chemical agent material into the solid wicking compound, thereby increasing the surface area of the chemical agent material and enhancing the destruction of the chemical agent material by combustion with atmospheric oxygen.

19. A method for making the self-sustaining reactive composition of claim 17 for defeating chemical agent material comprising:

mixing (i) the at least one reactive metal in the form of a dry powder, (ii) the at least one oxidizer in the form of a dry powder, and (iii) the binder, wherein said composition, when ignited, self-reacts to generate an elevated temperature and elevated thermal energy sufficient to render ineffective said chemical agent material by wicking action and combustion with atmospheric oxygen.

* * * * *